US009163866B2

(12) United States Patent
Buckley et al.

(10) Patent No.: US 9,163,866 B2
(45) Date of Patent: Oct. 20, 2015

(54) SYSTEM PRESSURE ACTUATED CHARGE COMPENSATOR

(75) Inventors: Paul K. Buckley, Carrollton, TX (US); Pete J. Den Boer, The Colony, TX (US); Robert B. Noll, Bedford, TX (US)

(73) Assignee: Lennox Industries Inc., Richardson, TX (US)

( * ) Notice: Subject to any disclaimer, the term of this patent is extended or adjusted under 35 U.S.C. 154(b) by 810 days.

(21) Appl. No.: 11/564,895

(22) Filed: Nov. 30, 2006

(65) Prior Publication Data

US 2008/0127667 A1 Jun. 5, 2008

(51) Int. Cl.
*F25B 45/00* (2006.01)

(52) U.S. Cl.
CPC ..... *F25B 45/00* (2013.01); *F25B 2345/001* (2013.01); *F25B 2500/23* (2013.01); *F25B 2500/24* (2013.01); *F25B 2600/2523* (2013.01); *F25B 2700/21* (2013.01)

(58) Field of Classification Search
CPC ..... F25B 45/00; F25B 2345/001–2345/003; F25B 2345/006
USPC ..... 62/324.4, 149, 292, 77
See application file for complete search history.

(56) References Cited

U.S. PATENT DOCUMENTS 4,136,528 A * 1/1979 Vogel et al. ..... 62/174
4,365,482 A 12/1982 Langgard et al.
4,382,367 A * 5/1983 Roberts ..... 62/197
4,429,544 A 2/1984 McCarty
4,484,452 A * 11/1984 Houser, Jr. ..... 62/174
4,546,616 A 10/1985 Drucker
4,796,436 A * 1/1989 Voorhis et al. ..... 62/77
5,005,375 A * 4/1991 Manz et al. ..... 62/292
5,046,320 A * 9/1991 Loose et al. ..... 62/77
5,140,827 A 8/1992 Reedy
5,203,177 A 4/1993 Manz et al.
5,784,892 A 7/1998 Reedy
5,937,670 A * 8/1999 Derryberry ..... 62/324.4
6,122,923 A 9/2000 Sullivan
7,472,557 B2 * 1/2009 Kang et al. ..... 62/147
2005/0247070 A1 * 11/2005 Arshansky et al. ..... 62/77

OTHER PUBLICATIONS

HVAC Mechanic.com—Thermostatic Expansion Valve; copyright 2000 (revised Sep. 22, 2002).*

* cited by examiner

*Primary Examiner* — Cheryl J Tyler
*Assistant Examiner* — David Teitelbaum
(74) *Attorney, Agent, or Firm* — Bell Nunnally & Martin LLP; Craig J. Cox

(57) ABSTRACT

A system pressure actuated charge compensator for use with a heat pump having a liquid service valve and a vapor service valve. The charge compensator comprises a holding tank having first and second ports, a first pressure tap coupled to the first port and removeably coupleable to the vapor service valve, and a second pressure tap coupled to the second port and removeably coupleable to the liquid service valve. A heat pump system and a method of manufacturing a charge compensator are also provided.

7 Claims, 3 Drawing Sheets

SYSTEM PRESSURE ACTUATED CHARGE COMPENSATOR

TECHNICAL FIELD OF THE INVENTION

The present invention is directed, in general, to air conditioning systems and, more particularly, to a field-installed, system pressure actuated charge compensator not requiring brazing.

BACKGROUND OF THE INVENTION

In heat pump systems, the volume ratio is the internal volume of the outdoor coil versus the internal volume of the indoor coil. The indoor and outdoor coils in conventional heat pump systems are of the appropriate size to run efficiently in cooling and heating mode. When upgrading older heat pump systems from a low SEER rating to SEER 13 or higher in order to improve cooling performance, an imbalance can occur as the volume ratio changes. When the indoor coil volume is smaller than the outdoor coil volume, the system has a high volume ratio. Conversely, when the indoor coil volume is greater than the outdoor coil volume, the system has a low volume ratio. These conditions create an imbalance in the amount of refrigerant charge needed as the heat pump changes from heating to cooling mode, i.e., the system needs more refrigerant during the cooling cycle than during the heating cycle. Existing charge compensators comprise a tank with a vapor tube passing through the tank, but the vapor tube is not open to the tank. The tank inner volume is connected to the liquid line and the excess charge is thermally drawn into the tank when the tube is cold during the heating mode; the charge is thermally driven out during the cooling mode when the tube is warm during the cooling mode. This type of compensator, if used in the field, must be brazed into the system to assure that the system is vapor tight. This requires that the refrigerant charge be removed, the system be opened, the compensator brazed in place by a technician, and the total system be evacuated and recharged.

Accordingly, what is needed in the art is a charge compensator that does not require brazing the compensator into the liquid and vapor lines.

SUMMARY OF THE INVENTION

To address the above-discussed deficiencies of the prior art, the present invention provides, in one aspect, a charge compensator that is pressure activated for use with a heat pump having a liquid service valve and a vapor service valve. The charge compensator comprises a holding tank having first and second ports, a first pressure tap coupled to the first port and removeably coupleable to the vapor service valve, and a second pressure tap coupled to the second port and removeably coupleable to the liquid service valve. A heat pump system and a method of manufacturing a charge compensator are also provided.

The foregoing has outlined features of the present invention so that those skilled in the pertinent art may better understand the detailed description of the invention that follows. Additional features of the invention will be described hereinafter that form the subject of the claims of the invention. Those skilled in the pertinent art should appreciate that they can readily use the disclosed conception and specific embodiment as a basis for designing or modifying other structures for carrying out the same purposes of the present invention.

Those skilled in the pertinent art should also realize that such equivalent constructions do not depart from the spirit and scope of the invention.

BRIEF DESCRIPTION OF THE DRAWINGS

For a more complete understanding of the invention, reference is now made to the following descriptions taken in conjunction with the accompanying drawing, in which.

DETAILED DESCRIPTION

Figure 1:
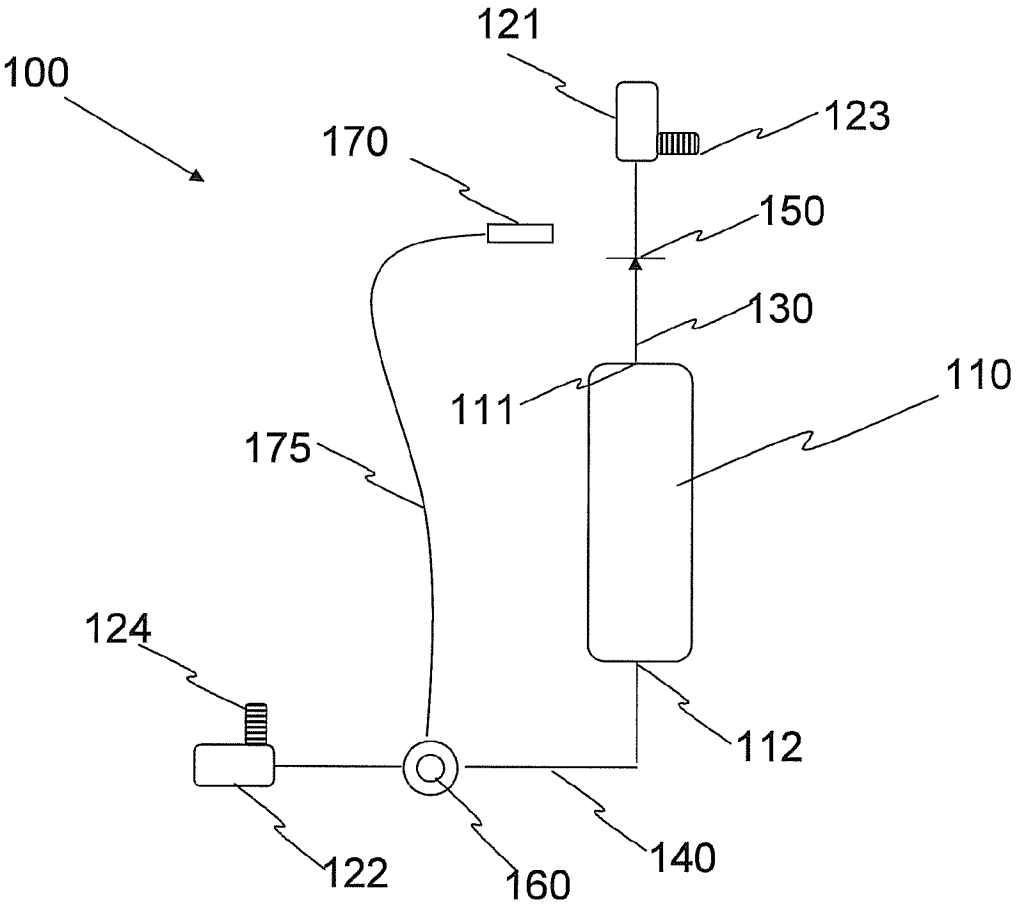
FIG. 1 illustrates a schematic view of one embodiment of a charge compensator kit for field installation constructed according to the principles of the present invention.

Referring initially to FIG. 1, illustrated is a schematic view of one embodiment of a charge compensator kit 100 for field installation constructed according to the principles of the present invention. In a preferred embodiment, the charge compensator kit 100 comprises a liquid tank 110 having a first port 111, a second port 112, a first pressure tap 121, a second pressure tap 122, a vapor line 130, a liquid line 140, a check valve 150, a thermostatic expansion valve (TXV) 160, a TXV sensing bulb 170, and a sensing line 175. The first and second pressure taps 121, 122, respectively, have for service work first and second auxiliary ports 123, 124, respectively. The vapor line 130 fluidly couples the first port 111 and the first pressure tap 121. The liquid line 140 fluidly couples the second port 112 and the second pressure tap 122. The first and second pressure taps 121, 122, respectively are removeably coupleable to service valves (not shown) of a heat pump system. For the purposes of this discussion, removeably coupleable means that the first and second pressure taps 121, 122 are threaded and therefore may be removed from the system with conventional mechanical tools and without the need for brazing or de-brazing of the system. The check valve 150 is interposed the first port 111 and the first pressure tap 121. The thermostatic expansion valve 160 is interposed the second port 112 and the second pressure tap 122. The TXV sensing bulb 170 is coupled to the TXV 160 by the sensing line 175. The first and second ports 111, 112 open into an interior of the liquid holding tank 110. In contrast, the prior art relied upon a tube passing through an interior of the tank from the first port to the second port and not open to the interior of the tank. The prior art relied upon a passive action of the temperature of the refrigerant passing through the tube to withdraw from or return excess refrigerant to the system.

Figure 2:
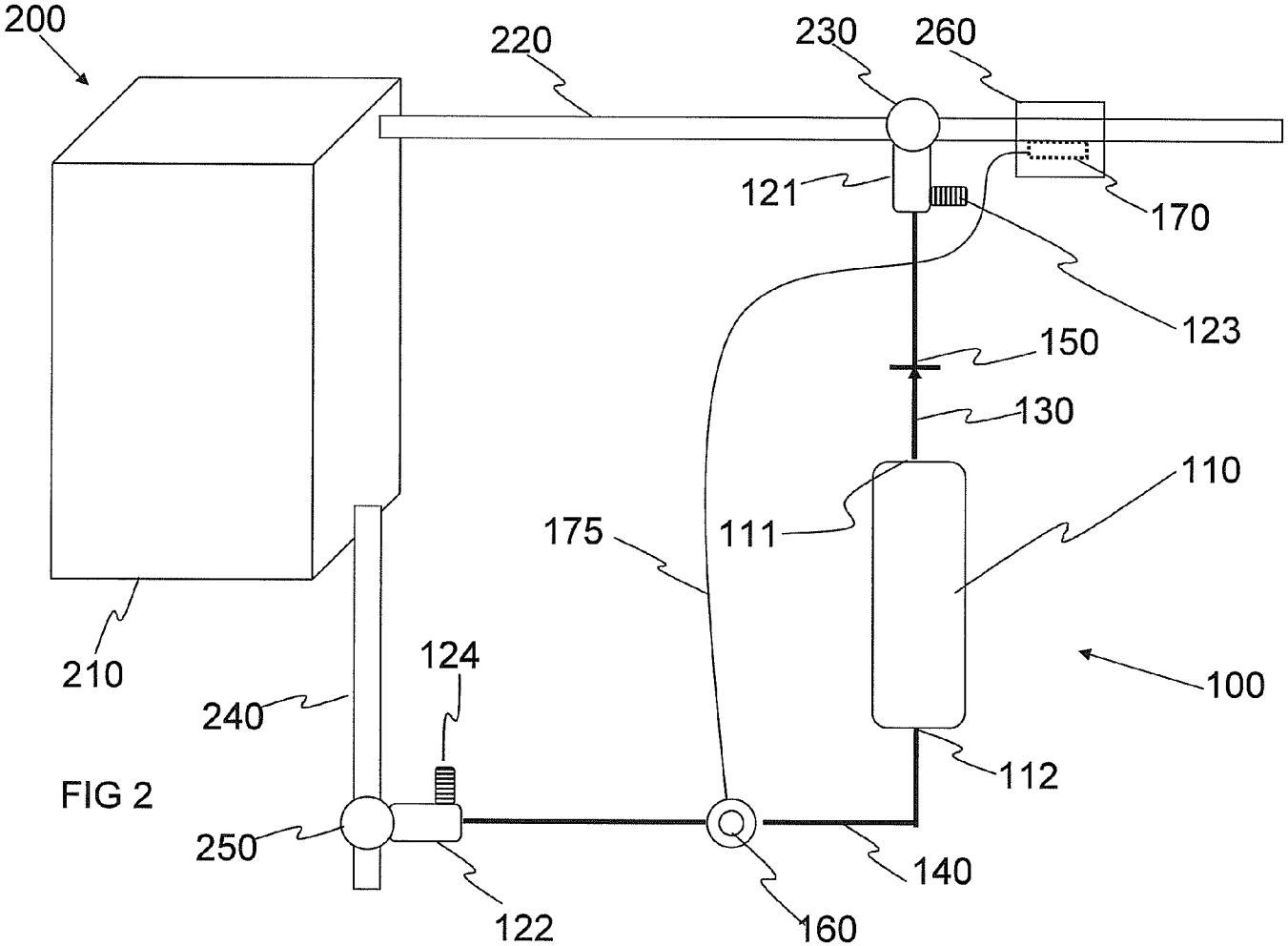
FIG. 2 illustrates a schematic view of an external unit of a heat pump system having installed thereon the charge compensator kit of FIG. 1.

Referring now to FIG. 2, illustrated is a schematic view of an external unit 200 of a heat pump system having installed thereon the charge compensator kit 100 of FIG. 1. The heat pump external unit 200 comprises an outdoor coil or heat exchanger 210, a system common vapor line 220, a vapor service valve 230, a system common liquid line 240, and a liquid service valve 250. The first pressure tap 121 removeably couples to the vapor service valve 230 by threading. In a like manner, the second pressure tap 122 removeably couples to the liquid service valve 250 by threading. The TXV sensing bulb 170 mechanically couples to an exterior of the vapor line 220 and is covered with insulation 260. The insulation 260 assures that the TXV sensing bulb 170 is sensing the temperature of the vapor line and excludes other outside influences, such as sunlight.

To install the charge compensator kit 100 on the heat pump external unit 200, the system refrigerant charge is first pumped into the outdoor heat exchanger 210. The second pressure tap 122 is removeably coupled to the liquid service valve 250 and the first pressure tap 121 is removeably coupled to the vapor service valve 230. The TXV sensing bulb 170 is coupled to the vapor line 220 and is covered with insulation 260. When the physical installation is complete, the system may be evacuated through first and second auxiliary ports 123, 124 on the first and second pressure taps 121, 122 as required. The refrigerant charge is then released from the outdoor heat exchanger 210 and the system is ready for operation.

The proposed field installed system works based on the pressure difference between the common liquid refrigerant line 240 and the common vapor refrigerant line 220. In the cooling mode the common vapor pressure is lower than the common liquid pressure. Conversely, the common vapor pressure is higher in the heating mode. During operation of the heat pump system in heating mode, excess refrigerant charge is routed into the tank 110 through the liquid line 140 and the TXV 160 controlled by the TXV sensing bulb 170. Note that the vapor line does not pass through the tank 110, but rather opens into the tank 110. This allows the tank to operate as a reservoir and therefore is actively controlled by operation of the TXV 160 in contrast to the passive operation in the prior art of relying on the temperature of the refrigerant passing through the central vapor line to withdraw from or return excess refrigerant to the system. This provides a more accurate relationship of available charge to the required refrigerant capacity. During operation of the heat pump system in cooling mode, refrigerant charge held in the tank 110 is released into the vapor line 130 through the check valve 150. During the heating mode, the vapor line 220 is at a higher pressure than the liquid line 140; this allows liquid refrigerant to accumulate in the tank 110.

Figure 3:
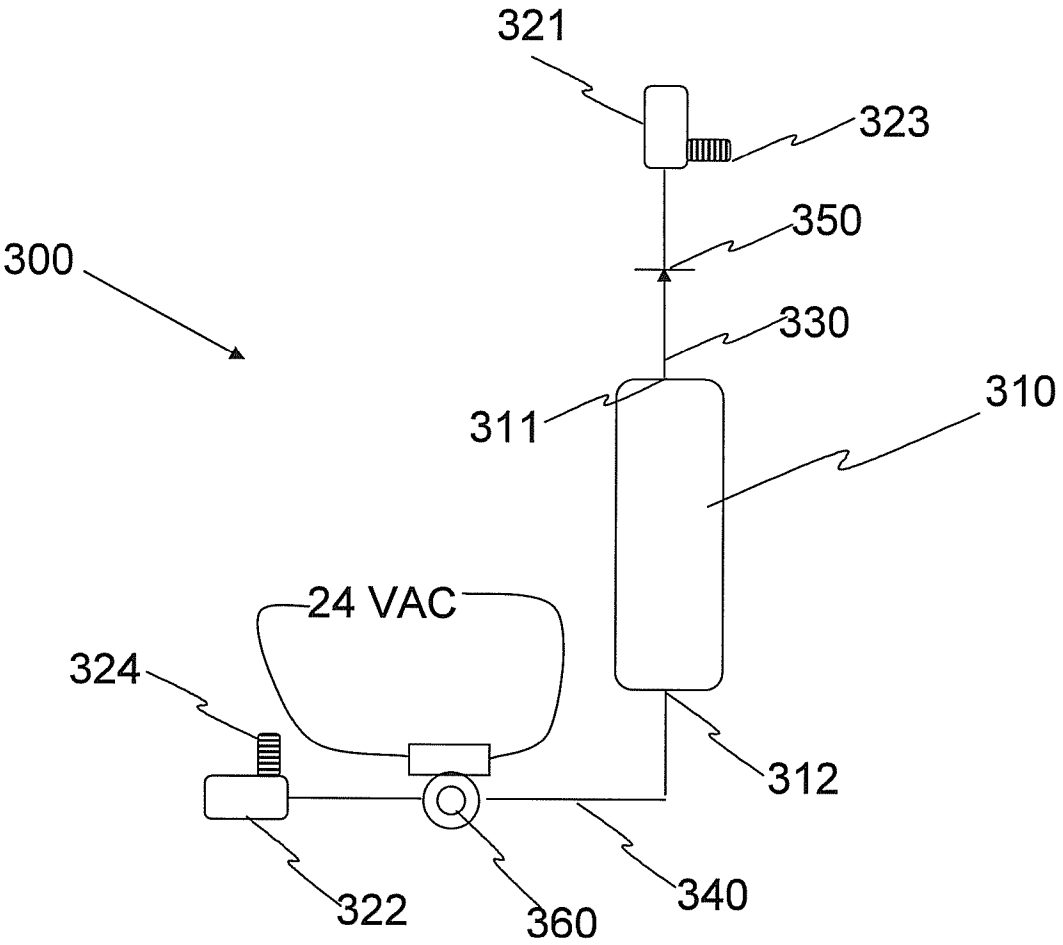
FIG. 3 illustrates a schematic view of an alternative embodiment of a charge compensator kit for field installation constructed according to the principles of the present invention.

Referring now to FIG. 3, illustrated is a schematic view of an alternative embodiment of a charge compensator kit 300 for field installation constructed according to the principles of the present invention. In a preferred embodiment, the charge compensator kit 300 comprises a liquid tank 310 having a first port 311 and a second port 312, a first pressure tap 321, a second pressure tap 322, a vapor line 330, a liquid line 340, a check valve 350, and a liquid line solenoid valve 360. The liquid tank 310; first and second pressure taps 321, 322, respectively; vapor line 330; liquid line 340, and check valve 350 are installed and function identically to their analogous parts of the charge compensator kit 100 of FIG. 1. However, flow through the liquid line 340 is controlled by the liquid line solenoid valve 360 powered by 24 VAC instead of the TXV 160, which can be directed by the central thermostat.

Thus, a field-installed charge compensator kit has been described. The charge compensator kit may be installed on the vapor and liquid service valves of an external heat pump heat exchanger so as to compensate for different charges required for heating vs. cooling when the indoor and outdoor heat exchangers are of different sizes. This condition is regularly encountered when the outdoor heat exchanger is upgraded to improve cooling performance.

Although the present invention has been described in detail, those skilled in the pertinent art should understand that they can make various changes, substitutions and alterations herein without departing from the spirit and scope of the invention in its broadest form.

What is claimed is:

1. A method of manufacturing a charge compensator, comprising:

providing a holding tank having first and second ports;

coupling a first pressure tap to said first port, said first pressure tap removeably coupleable to a vapor service valve of an outdoor heat exchanger of a heat pump system, said first pressure tap having a first auxiliary port therein, wherein said first auxiliary port permits evacuation of a vapor line connected to said vapor service valve without disconnecting said first pressure tap from said vapor service valve and coupling a second pressure tap to said second port, said second pressure tap removeably coupleable to a liquid service valve of said outdoor heat exchanger, and further including interposing a check valve between said first pressure tap and said first port, wherein said check valve permits a refrigerant located in said holding tank to travel to said vapor line when said heat pump is in a cooling mode.

2. The method as recited in claim 1, wherein said first and second ports open into an interior of said holding tank.

3. The method as recited in claim 1, wherein said first pressure trap is located between said vapor service valve and said first port.

4. A method of manufacturing a charge compensator, comprising:

providing a holding tank having first and second ports;

coupling a first pressure tap to said first port, said first pressure tap removeably coupleable to a vapor service valve of an outdoor heat exchanger of an external unit of a heat pump system, said first pressure tap having a first auxiliary port therein, wherein said first auxiliary port permits evacuation of a vapor line connected to said vapor service valve without disconnecting said first pressure tap from said vapor service valve; and coupling a second pressure tap to said second port, said second pressure tap removeably coupleable to a liquid service valve of said outdoor heat exchanger, and further including interposing an expansion device between said second pressure tap and said second port, wherein said expansion device permits a refrigerant to travel from said outdoor heat exchanger to said holding tank when said heat pump is in a heating mode.

5. The method as recited in claim 4, wherein said expansion device includes a thermostatic expansion valve.

6. The method as recited in claim 5, further including coupling a sensing bulb to said thermostatic expansion valve and mechanically coupling said sensing bulb to an exterior surface of said vapor line.

7. The method as recited in claim 4, wherein said first pressure trap is located between said vapor service valve and said first port.

* * * * *